US008653395B2

(12) United States Patent
Marquezin et al.

(10) Patent No.: US 8,653,395 B2
(45) Date of Patent: Feb. 18, 2014

(54) CIRCUIT BREAKER WITH TWO ALIGNED BREAKER CHAMBERS, A COMMON TRANSMISSION, AND REDUCED SIZE

(75) Inventors: Gwenael Marquezin, Villeurbanne (FR); André Cimala, Villeurbanne (FR)

(73) Assignee: Alstom Technology Ltd, Paris (FR)

( * ) Notice: Subject to any disclaimer, the term of this patent is extended or adjusted under 35 U.S.C. 154(b) by 328 days.

(21) Appl. No.: 12/682,586

(22) PCT Filed: Oct. 14, 2008

(86) PCT No.: PCT/EP2008/063768

§ 371 (c)(1),
(2), (4) Date: May 25, 2010

(87) PCT Pub. No.: WO2009/050154

PCT Pub. Date: Apr. 23, 2009

(65) Prior Publication Data

US 2010/0270266 A1 Oct. 28, 2010

(30) Foreign Application Priority Data

Oct. 15, 2007 (FR) ..... 07 58322

(51) Int. Cl.
*H01H 33/14* (2006.01)

(52) U.S. Cl.
USPC ..... 218/4; 218/79; 218/14

(58) Field of Classification Search
USPC ..... 218/2–9, 43–47, 58, 67–71, 76–84, 218/152–154
See application file for complete search history.

(56) References Cited

U.S. PATENT DOCUMENTS

| | | | | |
|---|---|---|---|---|
| 3,895,202 | A | 7/1975 | Okerman | |
| 3,896,282 | A | 7/1975 | Chabala | |
| 4,319,105 | A * | 3/1982 | Lott et al. | 218/57 |
| 4,378,751 | A | 4/1983 | Lott | |
| 5,668,360 | A * | 9/1997 | Perret et al. | 218/5 |
| 5,955,715 | A * | 9/1999 | Perret | 218/43 |

FOREIGN PATENT DOCUMENTS

| | | | |
|---|---|---|---|
| CH | 620790 | A5 | 12/1980 |
| EP | 0721197 | A1 | 7/1996 |
| FR | 2267625 | | 11/1975 |
| FR | 2729250 | A1 | 7/1996 |

OTHER PUBLICATIONS

International Search Report, PCT/EP2008/063768, Dated Jan. 26, 2009.
French Preliminary Search Report, FR0758322, dated May 16, 2008.

* cited by examiner

*Primary Examiner* — Amy Cohen Johnson
*Assistant Examiner* — Marina Fishman
(74) *Attorney, Agent, or Firm* — Nixon Peabody LLP

(57) ABSTRACT

A very high voltage circuit breaker comprising, for each phase, at least two breaker chambers aligned with each other, each chamber including a pair of main contacts, a pair of arcing contacts that are stationary relative to the main contacts, and a nozzle for blowing out hot gases resulting from the breaking operations, the pairs of contacts being partly of complementary male and female forms, each comprising at least one movable contact, the nozzle being stationary relative to the movable main contact and arcing contact.

12 Claims, 1 Drawing Sheet

CIRCUIT BREAKER WITH TWO ALIGNED BREAKER CHAMBERS, A COMMON TRANSMISSION, AND REDUCED SIZE

CROSS REFERENCE TO RELATED APPLICATIONS OR PRIORITY CLAIM

This application is a national phase of International Application No. PCT/EP2008/063768, entitled, "Compact Common-Transmission Circuit Breaker Having Two Aligned Cut-Off Chambers", which was filed on Oct. 14, 2008, and which claims priority of French Patent Application No. 07 58322, filed Oct. 15, 2007.

TECHNICAL FIELD AND PRIOR ART

This invention relates to the field of high voltage and very high voltage circuit breakers (metalclad and dead tank) comprising, for each phase, at least two breaker chambers aligned with each other and having a common transmission.

The mechanical synchronization that is obtained by the transmission common to the movable contacts of the aligned breaker chambers enables the current to be split during the operation of breaking a fault current (such as a short circuit current), so as to facilitate extinction of the arc.

In practice, in order to transmit the movement of a first breaker chamber to a second breaker chamber, insulating drawbars outside the chambers are used to open the set of movable contacts simultaneously. The use of such drawbars also involves the need to use hoods, as well as the need to provide for long insulating distances, that is to say considerable distances between the drawbars at line voltage and the cladding at ground potential.

For example, the document U.S. Pat. No. 3,896,282 may be mentioned, in which the transmission which is common to both of the breaker chambers is made in the form of two external drawbars 32 and 44.

The document FR 2 729 250 may also be mentioned, to disclose a common transmission which is made in the form of two external drawbars 41B and 51B.

The document U.S. Pat. No. 3,895,202 also discloses a common transmission having four breaker chambers aligned with each other and made in the form of two external drawbars 80 and 82.

It is also known to arrange for the transmission of movement to take place through the interior of the breaker chambers.

Thus the document U.S. Pat. No. 4,319,105 shows a circuit breaker structure with three breaker chambers aligned with each other, in which the movement is transmitted through drawbars 98, 98A, 98B inside the casing 63, and connecting the arcing bars which are the movable arcing contacts (see FIGS. 2 and 3 for example).

The document CH 620 790 shows a circuit breaker structure with two breaker chambers 2*a* and 2*b* aligned with each other, in which the transmission of movement takes place through an insulating actuating tube 3 which is fastened to each compression cylinder 4*a*, 4*b* of the breaker chambers, which is itself fastened to the socket 14*a*, 14*b* and to the nozzle 17*a*, 17*b*, and the actuating tube 3 surrounds the stationary arcing rod 12*b* of the first chamber (see FIG. 1).

The document FR 2 267 625 shows a circuit breaker structure with at least two chambers aligned with each other, in which the transmission of motion is achieved through internal drawbars 39 which connect the movable arcing bar 25 of the first chamber to the movable cylinder 31 at the end of which the nozzle 37 is arranged.

If the structures thus described in each of the last three documents mentioned above have the advantage of eliminating the external transmission drawbars, and, in consequence, also the hoods that were necessary and the apertures for mechanical securing of the said drawbars, but they do result in a not inconsiderable radial size and the circuit breaker is very long.

The object of the invention is accordingly to propose a solution which enables the radial size and the total length of the circuit breaker to be reduced.

DISCLOSURE OF THE INVENTION

To this end, the invention provides a high or very high voltage circuit breaker comprising, for each phase, at least two breaker chambers aligned with each other, in which each chamber includes a pair of main contacts, a pair of arcing contacts that are stationary relative to the main contacts, and a nozzle for blowing out hot gases resulting from the breaking operations, the pairs of contacts being partly of complementary male and female forms, each comprising at least one movable contact, the nozzle being stationary relative to the main movable contact and arcing contact, wherein the transmission of the simultaneous movement between the movable contacts of the first breaker chamber and the movable contacts of the second breaker chamber is performed by a transmission assembly which is fastened directly, firstly to the movable main contact of the first chamber, and secondly the movable arcing contact of the second chamber, the transmission assembly being contained inside the two breaker chambers.

In accordance with the invention, the movement is transmitted from one breaker chamber to the other directly or through the main contact of the first chamber.

Thus, by means of the invention, the hoods that are used in the prior art are no longer necessary, and at least a portion of the transmission assembly can be made of metal.

The expression "fastened directly to" should be understood here and within the scope of the invention to mean that the transmission assembly is coupled in movement by direct contact, firstly with the movable main contact of the first breaker chamber, and secondly with the movable arcing contact of the second breaker chamber.

In other words, the mechanical force from the transmission assembly of the invention is exerted directly on the main contact tube, which must therefore support mechanical forces in both tension and compression.

Because of the mechanical force exerted directly on the main contact tube of the first breaker chamber, the transmission assembly is contained completely inside the two transmission chambers. This enables the radial size to be reduced, but it also reduces the length of the circuit breaker.

Advantageously, the transmission assembly is contained within the two breaker chambers by being arranged between, respectively, the nozzle and the main contact, between the stationary main contact and the stationary arcing contact of the first breaker chamber and between the stationary arcing contact and the end of the movable arcing contact of the second chamber closest to the first chamber.

In one embodiment, each pair of contacts comprises two movable contacts, additional transmission means for separating the main contacts from each other and the arcing contacts during a breaking operation being provided for each breaker chamber.

In a variant, one of the arcing contacts of at least the first breaker chamber is stationary and in the form of an arcing bar extended by at least one leg that is fastened to a stationary outer wall of the circuit breaker, the transmission assembly, which is fastened directly to the movable main contact of the first breaker chamber and the movable arcing contact of the second chamber, being arranged partly within the space delimited by the or each leg and the stationary outer wall.

In the same variant, the stationary arcing bar is extended by a tripod up to the stationary outer wall.

In a further variant, the transmission assembly comprises at least one insulating part that is fastened directly to the movable main contact and that is connected electrically in parallel with the nozzle of the first breaker chamber, the insulating part being disposed coaxially with the nozzle, and, if necessary, at least partially in engagement against the nozzle.

In one embodiment, the movable arcing contact of the first breaker chamber is in the form of a hollow cylinder, and the transmission assembly includes a transmission member that is coupled directly to the hollow cylinder by means of a spigot.

The transmission assembly may include rods and/or a tube.

In another embodiment, the tube of the transmission assembly is cut away in such a way as to leave a passage for the or each leg of the stationary arcing contact.

Preferably, the transmission assembly includes an isolating portion that partially surrounds the nozzle in its length direction, and that is fastened directly to the movable main contact of the first breaker chamber.

In yet another embodiment, an insulating part of the transmission assembly and the blast nozzle are made in one piece.

Within the scope of the invention, the movement is initiated by the arcing contact in the form of a bar, or by the arcing contact in the form of a socket.

The invention also provides the use of a circuit breaker as part of a metalclad switchgear unit.

BRIEF DESCRIPTION OF THE DRAWINGS

Further advantages and features of the invention will appear more clearly on a reading of the detailed description which is given below with reference to the attached FIGS. 1 and 2.

DETAILED DESCRIPTION OF PARTICULAR EMBODIMENTS

The high or very voltage circuit breaker D shown includes, for each phase, at least two breaker chambers Ca, Cb and Cc that are aligned with each other along the axis X-X'.

Each chamber Ca, Cb includes, respectively, a pair of main contacts 7*a*, 8*a*, 7*b*, 8*b*, a pair of arcing contacts 1*a*, 2*a*; 1*b*, 2*b*, each of which is fastened to one of the main contacts, being partly in the complementary male and female forms shown. Each pair of contacts includes a single main contact 7*a*, 7*b* or movable arcing contact 1*a*; 1*b*. Each chamber Ca or Cb also includes a nozzle 3*a*, 3*b* for blowing out hot gases resulting from the current breaking operation, the nozzle 3*a* or 3*b* being stationary relative to the main contact 7*a* or 7*b* and movable contacts 1*a* and 1*b* (see FIGS. 1 and 2).

The initiation of movement is obtained conventionally, that is to say by means of an insulating actuating rod or bar, not shown, for operating the circuit breaker, this rod or bar being coupled directly to the arcing contact 1*a*.

Figure 1:
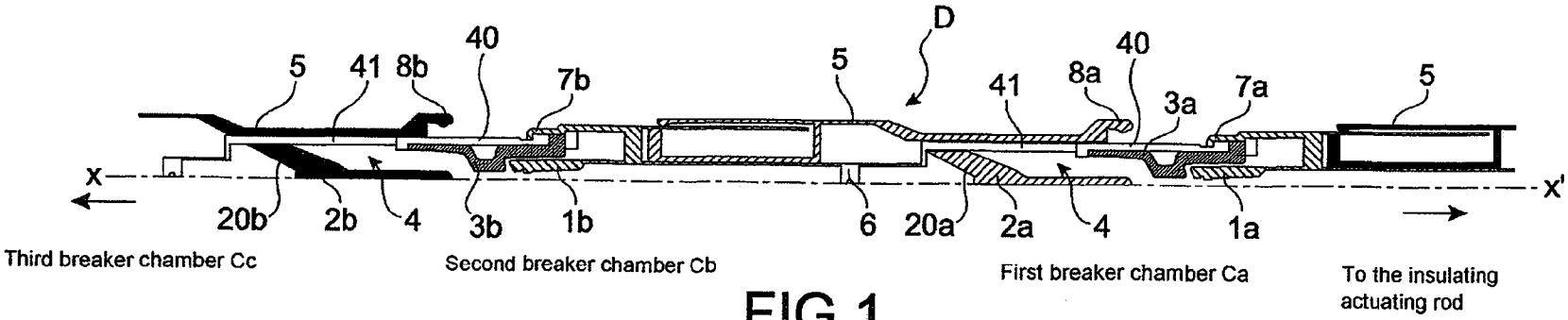
FIG. 1 shows, in a longitudinal half section, a very high voltage circuit breaker in one embodiment of the invention, shown in an open position, that is to say after a current has been broken thereby.
Figure 2:
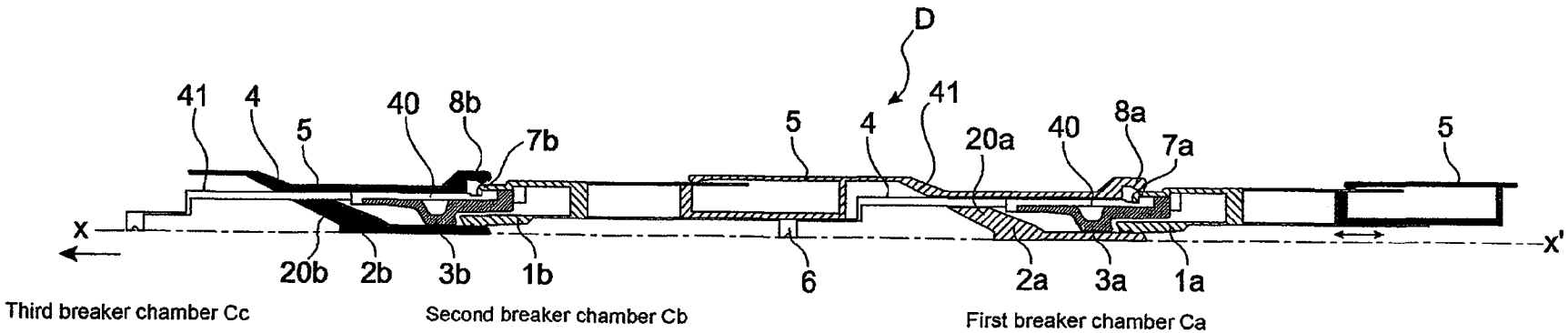
FIG. 2 shows the circuit breaker of FIG. 1, but in a closed position, that is to say with the current unbroken.

In accordance with the invention, the movement is transmitted simultaneously from a breaker chamber C1 of the high or very high voltage circuit breaker D to the other chamber C2, through the movable main contact 7*a*, by passing through the insides of the chambers (see FIGS. 1 and 2).

Thus, the transmission of the movement of the movable arcing contact of the first breaker chamber Ca to that of the second breaker chamber Cb is obtained by means of a transmission assembly 4, 40, 41 which is fastened directly, firstly to the movable main contact 7*a* of the first breaker chamber Ca, and secondly to the movable arcing contact 1*b* of the second chamber, the transmission assembly 4 being contained inside the two breaker chambers Ca and Cb.

The transmission assembly 4 shown is such that it is arranged between, respectively, the nozzle 3*a* and the main contacts 7*a* and 8*a*, between the stationary main contact 8*a* and the stationary arcing contact 2*a* of the first breaker chamber Ca, and between the stationary arcing contact 2*b* and the end of the movable arcing contact 1*b* of the second breaker chamber Cb that is closest to the first chamber Ca.

In the shown embodiment, the arcing contacts 2*a* and 2*b* of the breaker chambers Ca and Cb are stationary, and each is in the form of an arcing bar that is extended in length by a tripod 20*a*, 20*b* extending up to the stationary outer wall 5 of the circuit breaker.

The transmission assembly is fastened directly to the movable main contact 7*a* of the first chamber Ca and to the movable arcing contact of the second chamber, which is in the form of a hollow cylinder 1*b*.

The transmission assembly 4 includes a transmission member 41 which is coupled directly to the hollow cylinder 1*b* through a spigot 6 (although another fastening system is possible since the degree of freedom afforded by the spigot is not absolutely necessary: a screw coupling is also possible).

In the form of construction shown in the drawings, the transmission assembly 4 includes a composite tube 40, 41.

Thus it includes the insulating tubular portion 40 which is electrically connected in parallel with the nozzle 3*a*, together with a tubular portion 41, the material of which has no importance from the electrical (or dielectric) point of view, and the main function of which is accordingly to transmit the movement between the two breaker chambers Ca and Cb.

This function can very well be ensured by means of a single insulating rod, which enables there to be only a single component to make and fit. In this version a hood can prove useful for protecting them from hot gases produced during a current breaking operation.

In the arrangement shown in the drawings, the components of the movement transmissions 4, 40 and 41 are bodies of revolution disposed around the axis XX', and have openings for the passage of fastening elements 20*a* of the breaker rod 2*a* (tripod) through them.

As shown in the drawings, the transmission assembly 4 includes an insulating portion 40 which partially surrounds the nozzle 3*a* lengthwise, by being directly in engagement against it and fastened directly to the movable main contact 7*a* of the first breaker chamber Ca, which is adapted to be separated from the stationary main contact 8*a* during a current breaking operation.

Various fastening means may be envisaged between the insulating portion 40 that is sandwiched between the nozzle 3*a* and the main contact 7*a*: for instance, direct screw fastening or bolting between these two components, or screw fastening or bolting through a metal member fitted between these two components, the tube being adhesively bonded on a metal flange, which is itself fastened to the movable contact.

In the embodiment shown in the drawings, it can be seen that the circuit breaker includes at least one third breaker chamber Cc, not shown, transmission of simultaneous movement between the second breaker chamber Cb and the said third chamber Cc being obtained in exactly the same way as that between the first chamber Ca and the second chamber Cb, that is to say with a further assembly 4, 40, 41 constructed and fastened identically. The insulating portion 40 of this further assembly also partially surrounds the nozzle 3*b* lengthwise, being in direct engagement against it, and is fastened to the movable main contact 7*b*, which is adapted to be separated from the stationary main contact 8*b* during a current breaking operation.

In the embodiment shown in the drawings, the stationary arcing rods 2*a* and 2*b* are each extended by a tripod 20*a* or 20*b*. It goes without saying, however, that any arrangement with one or two or more legs, fastened to the stationary outer wall 5, will be suitable. An arrangement having one or two legs disposed at 180° has the advantage that it leaves more space free for the passage of the portion 41 of the transmission assembly 4.

In the embodiment shown in the drawings, the initiation of the operating movement is done by the arcing contact 2*a*, in the form of a bar. Within the scope of the invention, it could just as well be done by an arcing contact in the form of a socket as is shown at 1*a*.

The advantages of the arrangement provided by the invention are numerous, such as the following:

reduction in diameter of the metal cladding in the application in which the circuit breaker is part of a metalclad switchgear unit;

elimination of all the insulating external drawbars for the purpose of transmitting the movement of the movable parts of one breaker chamber to those of another;

elimination of the hoods that are needed for external insulating drawbars, and elimination of their supporting structures;

elimination of the cut-outs or openings that are needed for the mechanical accommodation of the said external drawbars;

the possible use of metallic materials for making elements of the transmission assembly, such as rods; and reduction in weight of the movable components for each breaker chamber, and therefore reduction in the energy needed for operating the circuit breaker.

The invention claimed is:

1. A high or very high voltage circuit breaker comprising, for each phase, at least two breaker chambers aligned with each other, in which each includes a pair of main contacts, a pair of arcing contacts that are each fastened to one of the main contacts, and a nozzle for blowing out hot gases resulting from the breaking operations, the pairs of contacts being partly of complementary male and female forms, each comprising at least one movable contact, the nozzle being fastened to the movable main contact and arcing contact, each breaker chamber being radially delimited by the respective main contacts, wherein the simultaneous movement between the movable contacts of the first breaker chamber and the movable contacts of the second breaker chamber is performed by a transmission assembly that is fastened directly, firstly to the movable main contact of the first chamber, and secondly the movable arcing contact of the second chamber, the transmission assembly being contained inside the two breaker chambers, one of the arcing contacts of at least the first breaker chamber being stationary and fastened to a stationary outer wall of the circuit breaker.

2. A high or very high voltage circuit breaker according to claim 1, wherein the transmission assembly is contained within the two breaker chambers by being arranged between, respectively, the nozzle and the main contact, between the stationary main contact and the stationary arcing contact of the first breaker chamber and between the stationary arcing contact and the end of the movable arcing contact of the second chamber closest to the first chamber.

3. A circuit breaker according to claim 1, wherein each pair of contacts comprises two movable contacts, additional transmission means for separating the main contacts and arcing contacts from each other during a breaking operation being provided for each breaker chamber.

4. A circuit breaker according to claim 1, wherein one of the arcing contacts of the first breaker chamber is in the form of an arcing bar extended by at least one leg that is fastened to the stationary outer wall of the circuit breaker, the transmission assembly, which is fastened directly to the movable main contact of the first breaker chamber and the movable arcing contact of the second chamber, being arranged partly within the space delimited by the or each leg and the stationary outer wall.

5. A circuit breaker according to claim 4, wherein the stationary arcing bar is extended by a tripod up to the stationary outer wall.

6. A circuit breaker according to claim 1, wherein the transmission assembly comprises at least one insulating part that is fastened directly to the movable main contact and that is connected electrically in parallel with the nozzle of the first breaker chamber, the insulating part being disposed coaxially with the nozzle.

7. A circuit breaker according to claim 1, wherein the movable arcing contact of the first breaker chamber is in the form of a hollow cylinder, and wherein the transmission assembly includes a transmission member that is coupled directly to the hollow cylinder by means of a spigot.

8. A circuit breaker according to claim 1, wherein the transmission assembly includes rods and/or a tube.

9. A circuit breaker according to claim 8, wherein one of the arcing contacts of the first breaker chamber is in the form of an arcing bar extended by at least one leg that is fastened to the stationary outer wall of the circuit breaker, the transmission assembly, which is fastened directly to the movable main contact of the first breaker chamber and the movable arcing contact of the second chamber, being arranged partly within the space delimited by the or each leg and the stationary outer wall and wherein the tube of the transmission assembly is cut away in such a way as to leave a passage for the or each leg of the stationary arcing contact.

10. A circuit breaker according to claim 1, wherein an insulating part of the transmission assembly and the blast nozzle are made in one piece.

11. A circuit breaker according to claim 1, wherein the movement is initiated by the arcing contact in the form of a bar.

12. The use of a circuit breaker according to claim 1 as part of a metalclad switchgear unit.

* * * * *

UNITED STATES PATENT AND TRADEMARK OFFICE

CERTIFICATE OF CORRECTION

PATENT NO. : 8,653,395 B2
APPLICATION NO. : 12/682586
DATED : February 18, 2014
INVENTOR(S) : Marquezin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 501 days.

Signed and Sealed this
Twenty-ninth Day of September, 2015

Michelle K. Lee

Michelle K. Lee
*Director of the United States Patent and Trademark Office*